US007357632B1

(12) United States Patent
Sullivan et al.

(10) Patent No.: US 7,357,632 B1
(45) Date of Patent: Apr. 15, 2008

(54) AUTOMATED WOOD-FIRED POTTERY KILN

(76) Inventors: Andrew Dennis Sullivan, 3210 St. John's Ave., Billings, MT (US) 59102; Michelle Millhollin Sullivan, 3210 St. John's Ave., Billings, MT (US) 59102

( * ) Notice: Subject to any disclaimer, the term of this patent is extended or adjusted under 35 U.S.C. 154(b) by 177 days.

(21) Appl. No.: 11/336,556

(22) Filed: Jan. 20, 2006

(51) Int. Cl.
*F27D 17/00* (2006.01)

(52) U.S. Cl. ..... 432/179; 432/156

(58) Field of Classification Search ..... 432/179, 432/93, 217, 156; 110/235, 260
See application file for complete search history.

(56) References Cited

U.S. PATENT DOCUMENTS

| | | | | |
|---|---|---|---|---|
| 3,675,600 | A * | 7/1972 | Jones | 110/203 |
| 3,752,643 | A * | 8/1973 | Robinson | 432/120 |
| 3,992,139 | A | 11/1976 | Lovatt | 432/258 |
| 4,139,340 | A * | 2/1979 | Bartel | 432/179 |
| 4,412,814 | A * | 11/1983 | Dennis et al. | 432/146 |
| 4,445,024 | A | 4/1984 | Carden | 219/390 |
| 4,461,274 | A * | 7/1984 | Cauffman | 126/177 |
| 4,473,352 | A * | 9/1984 | Sonoda et al. | 432/96 |
| 4,692,593 | A | 9/1987 | Chiu | 219/362 |
| 6,244,195 | B1 * | 6/2001 | Yang | 110/248 |
| 2005/0120715 | A1 * | 6/2005 | Labrador | 60/618 |

* cited by examiner

*Primary Examiner*—Gregory Wilson
(74) *Attorney, Agent, or Firm*—Shane P. Coleman; Holland & Hart LLP

(57) ABSTRACT

A kiln and method of firing a kiln are provided for use in connection with the firing of small-scale pottery firing. The kiln includes a kiln wall that defines a main kiln volume that is no larger than 60 cubic feet and is less than 10 cubic feet in one embodiment. The main kiln volume is structured to receive a pottery item for firing. The kiln further includes a combustion chamber that is thermally connected to the main kiln volume. A feeder automatically feeds solid fuel to the combustion chamber to reach and maintain at least a cone 10 temperature within the main kiln volume. In use, solid fuel is automatically provided to a combustion chamber at a controlled rate and is combined with combustion air in the combustion chamber. The solid fuel is combusted in the combustion chamber to warm a thermally-connected main kiln volume.

29 Claims, 8 Drawing Sheets

AUTOMATED WOOD-FIRED POTTERY KILN

FIELD OF INVENTION

The present invention relates to pottery kilns. More particularly, the present invention relates to an automated, wood-fired pottery kiln and an automated method of feeding solid fuel into a pottery kiln.

BACKGROUND INFORMATION

A pottery or ceramics kiln is an instrument used to convert clay into finished pottery. The conversion is an irreversible process, known as vitrification, that partially melts and fuses clay into glass-like pottery through the application of high temperatures. The temperature required to complete the conversion process depends on the specific clay mixtures used. For a typical stoneware clay, temperatures on the order of 2345° F. are required to complete the conversion process.

Various heating processes exist for vitrifying pottery and ceramics. These include electric heating, natural gas combustion, propane combustion, and wood combustion. Electric processes utilize an oxidizing air atmosphere as the heating elements typically experience short service lives in reducing atmospheres. The combustion processes allow for both oxidizing and reducing atmospheres yielding greater flexibility in glazing operations and in the use of techniques such as salt firing. Wood combustion processes are held in particularly high regard based on the unique characteristics imparted to the fired piece and the renewable nature of the fuel source.

Electric kilns offer the benefit of simplicity of operation and scalability to small sizes suitable for amateur and small scale production uses. Natural gas and propane fired kilns are scalable from small to large size, but require a higher level of expertise to safely operate due to the hazardous nature of these fuels and the significant volumes required to fire a kiln. For this reason, natural gas and propane fired kilns enjoy limited use among amateur and small scale production users. Wood fired kilns offer inherent safety benefits compared to natural gas or propane kilns, but their use has been limited to professional, large-scale operators because of the labor intensive nature of wood firing and the large size and cost of the kilns. Conventional wood kilns are labor-intensive because the firing process requires a large quantity of wood, frequent refueling, and long firing times. For example, a minimum-sized wood kiln might require a cord or more of wood, with small pieces fed every few minutes during peak firing, and a total attended firing time of 24 to 48 hours. The large size of wood kilns is dictated by the size of the traditional cord wood fuel source and the labor intensive nature of the firing process which lends itself to large batch sizes. As a result, conventional wood-fired kilns are not practical for use by amateur and small scale production users.

SUMMARY OF THE INVENTION

There exists a need to provide a wood-fired kiln that overcomes at least some of the above-referenced deficiencies. Accordingly, at least this and other needs have been addressed by exemplary embodiments of the kiln according to the present invention. One such embodiment is directed to a kiln including a kiln wall that defines a main kiln volume that is no larger than 60 cubic feet. The main kiln volume is structured to receive a pottery item for firing. The kiln further includes a combustion chamber that is thermally connected to the main kiln volume. A feeder automatically feeds solid fuel to the combustion chamber to reach and maintain at least a cone 10 temperature within the main kiln volume.

In another exemplary embodiment of the present invention, a method of firing a kiln is provided. Solid fuel is automatically provided to a combustion chamber at a controlled rate. The solid fuel is combined with combustion air in the combustion chamber. The solid fuel is combusted in the combustion chamber to warm a thermally-connected main kiln volume to at least a cone 10 temperature.

In yet another exemplary embodiment of the present invention, a kiln is provided for firing pottery items. The kiln includes a means for automatically providing solid fuel to a combustion chamber at a controlled rate. The kiln further includes a means for combining the solid fuel with combustion air in the combustion chamber. The kiln further includes a means for combusting the solid fuel in the combustion chamber to reach at least a 10 cone temperature in a main kiln volume. The main kiln volume is thermally connected to the combustion chamber and is no greater than 60 cubic feet.

BRIEF DESCRIPTION OF DRAWINGS

The detailed description will refer to the following drawings, wherein like numerals refer to like elements, and wherein.

DETAILED DESCRIPTION

Figure 1:
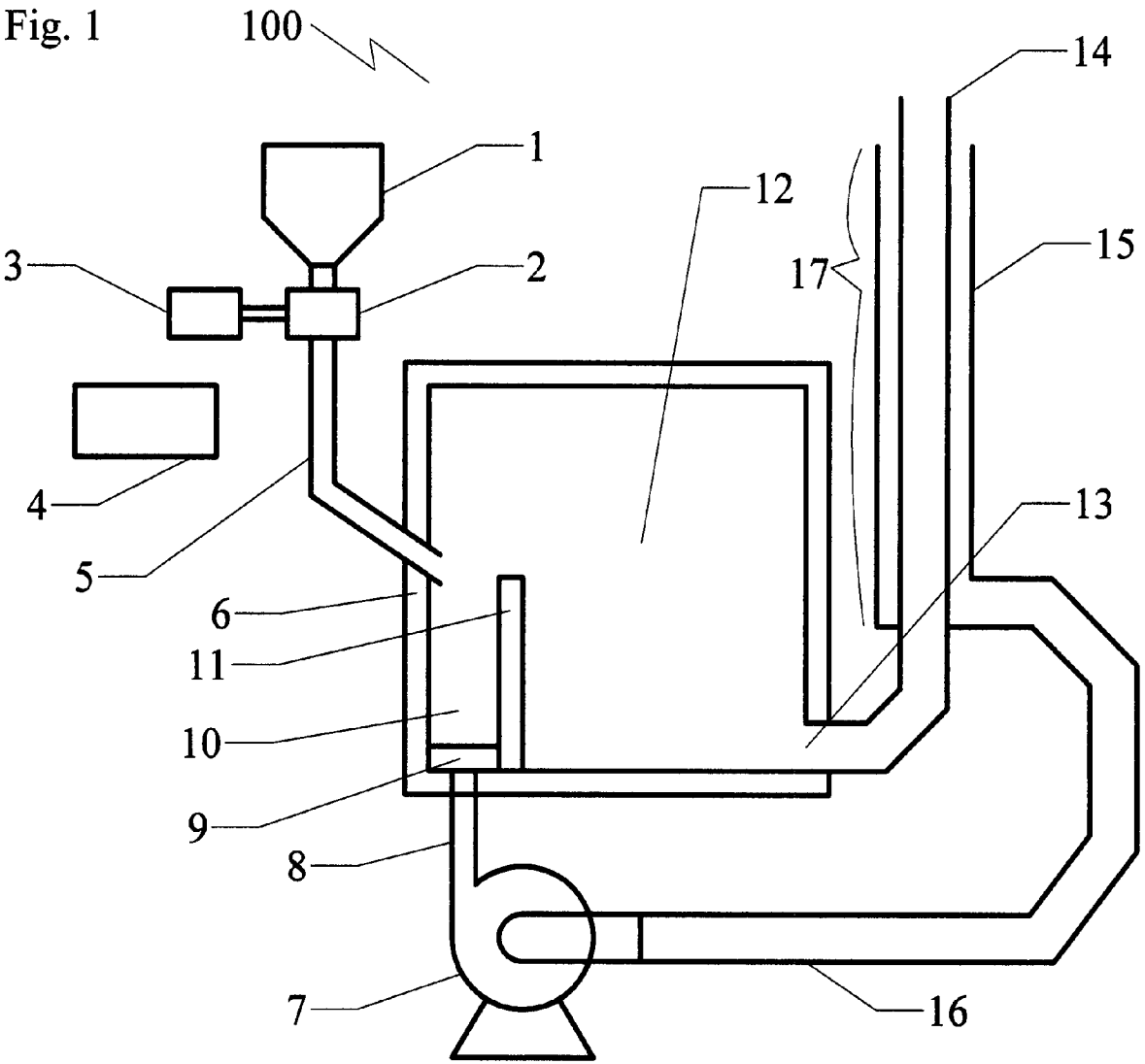
FIG. 1 shows a schematic diagram of one embodiment of a kiln according to the present invention.

FIG. 1 shows a schematic diagram showing one embodiment of a kiln 100 according to the present invention. Solid fuel (not shown) to supply the kiln 100 is held in a storage arrangement, such as a hopper 1. In some applications, such as the use of a kiln 100 at home for personal or hobby use, it is desirable to minimize the size of the kiln 100. The size of the fuel limits the minimum size of a kiln 100 so in one embodiment it is desirable to utilize finely-divided fuels to scale down the size of a kiln 100. In a preferred embodiment of the present invention the fuel is wood pellets. The fuel (not shown) flows from a storage arrangement, such as the hopper 1 shown in FIG. 1, to a feeder 2. The feeder 2 controls the rate at which fuel is fed (the "fuel feed rate"), and can be embodied in various forms including without limitation an auger, a rotary valve, a lock hopper, conveyer mechanisms, or other feeding mechanisms. The feeder 2 is powered by an actuator 3, such as a gear motor, air motor, or other power source.

In the embodiment shown in FIG. 1, the fuel feed rate may be adjusted by adjusting the amount of fuel allowed to pass through feed mechanism 2. In one embodiment, the feed rate through feeder 2 may be adjusted with a controller 4. In one embodiment, the controller uses a gear-motor actuator 3 controlled by a motor-speed controller 4. One skilled in the art will recognize that the controller 4 may be embodied in various other forms.

Fuel (not shown) from the feeder 2 flows through the feed tube 5. Fuel from the feed tube 5 passes through kiln wall 6, and drops into combustion chamber 10. Combustion air is delivered to the kiln 100 with fan 7, such as a forced-draft fan in one embodiment. Air is directed from the fan 7 through a duct 8 and then through an air-distribution grate 9 at or near the bottom of combustion chamber 10 of the kiln 100.

Fuel combustion is completed in the combustion chamber 10 as the air reaches the fuel through the air grate 9. The combustion chamber 10 is formed by an internal partition 11. The internal partition 11 provides adequate combustion-chamber volume to complete combustion and to direct fully-combusted gasses to the main kiln volume 12. In one embodiment, the main kiln volume 12 is 60 cubic feet or less. In one particular embodiment, the main kiln volume 12 is 10 cubic feet or less, and in another particular embodiment described further herein, the main kiln volume 12 is approximately 3.75 cubic feet and is still capable of achieving a cone 10 temperature. Hot combustion gases heat the main kiln volume 12 and then exit the kiln 100 through the exhaust port 13. The exhausted gases are directed through the stack 14 into the atmosphere, at a safe location.

In the embodiment of FIG. 1, combustion air is preheated with a heat exchanger 17. A pipe-in-pipe heat exchanger configuration is depicted in the embodiment of FIG. 1, formed by inner and outer pipes 14, 15. Combustion gases passing through the outer pipe 15 are heated by exhaust gases passing through the inner pipe 14. Together, the inner and outer pipes 14, 15 of the example of FIG. 1 may be referred to as the stack. The hot internal pipe 14 heats cool combustion air as the combustion air passes between the outer and inner pipes 15, 14. In the embodiment shown, preheated air from the heat exchanger 17 passes through a duct 16 to the fan 7. Other embodiments may use different mechanisms to preheat combustion air before the combustion air reaches the combustion chamber 10.

Figure 2:
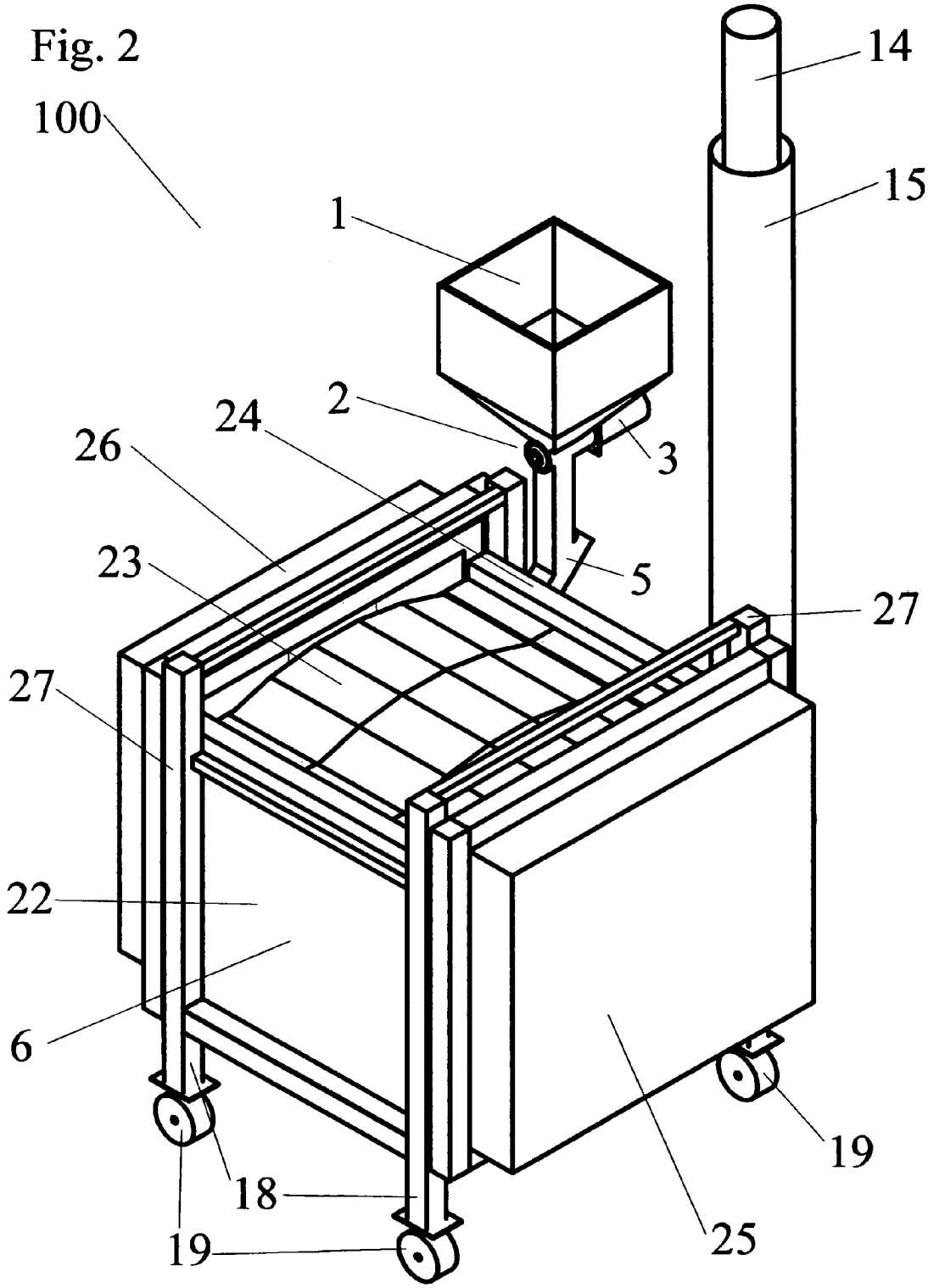
FIG. 2 shows a perspective view of one embodiment of the kiln.

FIG. 2 shows a perspective view of one embodiment of the kiln 100. In the embodiment shown, the kiln wall 6 comprises an inner enclosure of fire-resistant material, such as fire bricks 23 surrounded by insulating board 24, encapsulated by metal walls 22 surround the brick kiln wall 6. The fire bricks 23 provide an enclosure capable of containing high operating temperatures, such as "cone 10" temperatures of approximately 2345° F., or higher, in one embodiment. The insulating board 24 surrounding the fire bricks 23 provides insulation to help achieve and maintain the high temperatures with efficient fuel use. The metal shell 22 provides support for the fire bricks 23 and insulating board 24. The metal shell 22 is supported by kiln frame 27. In the embodiment shown, doors 25, 26 provide access to the main kiln volume 12 and to the combustion chamber 10 of the kiln 100, respectively. A first door 25 provides access to the main kiln volume 12, for example, for loading and unloading pottery. A second door 26 allows access to the combustion chamber 10 of the kiln 100, for example, for starting and cleaning the combustion chamber 10. The kiln 100 is adapted to be portable under hand power through the use of wheels, such as casters, connected to lower ends of legs 18. In other embodiments, the kiln 100 may include skids (not shown) or similar means of allowing the kiln 100 to be moved under hand power.

Figure 3:
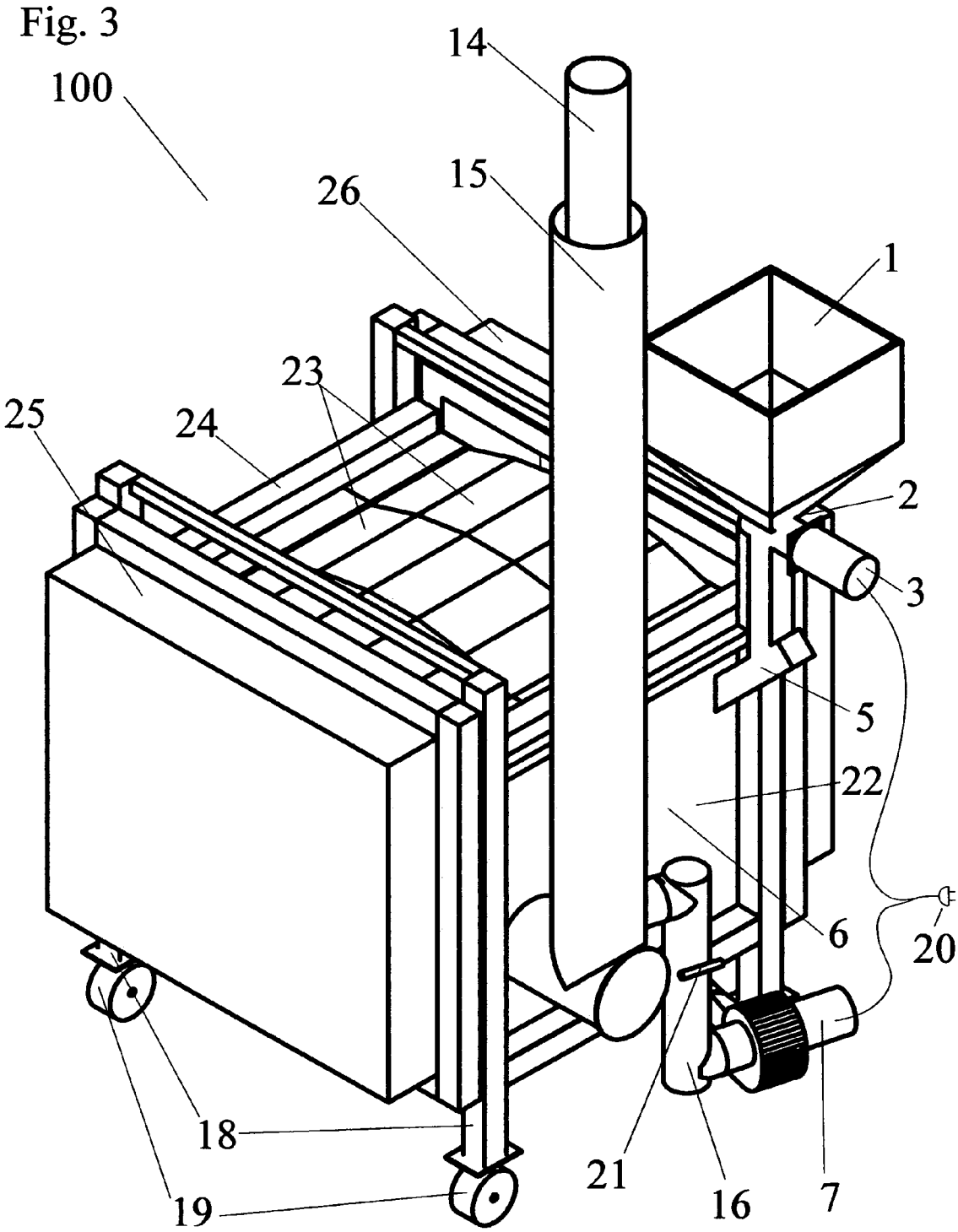
FIG. 3 shows a perspective view of the kiln shown in FIG. 2.

FIG. 3 shows a perspective view of the kiln 100 shown in FIG. 2. In this embodiment, a power cord 20 provides power to the fan 7 and to the gear motor actuator 3. In this embodiment, combustion air flow to the kiln 100 is controlled with a damper 21 located in the duct 16 connecting the outer pipe 15 to the fan 7.

Figure 4:
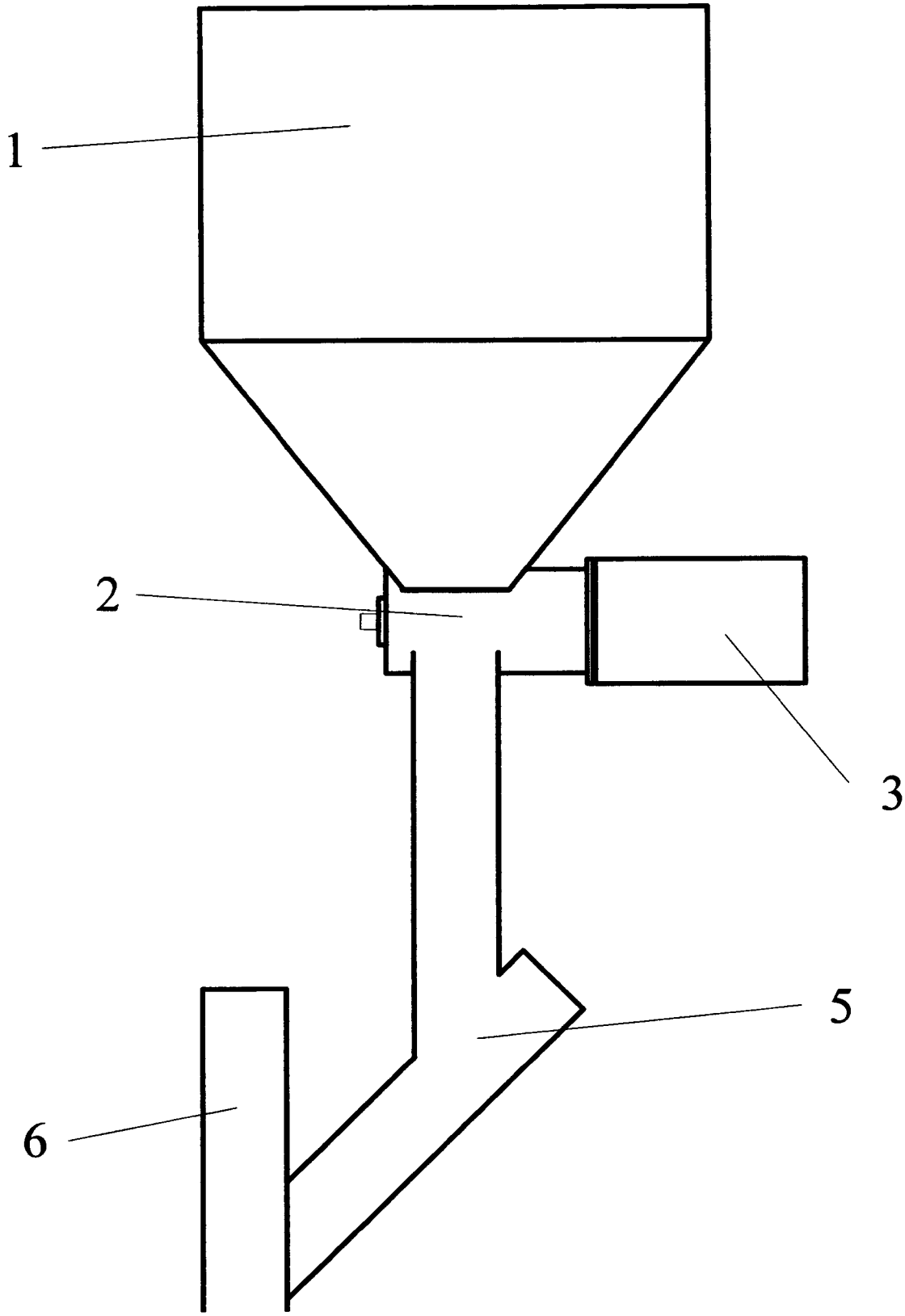
FIG. 4 shows a more detailed perspective view of the connection between the hopper and the kiln wall, as shown in FIGS. 2 and 3.

FIG. 4 shows a more detailed perspective view of the connection between the hopper 1 and the kiln wall 6, as shown in FIGS. 2 and 3. In this embodiment, fuel is fed from a funnel-shaped hopper 1 using a feeder 2. The feeder 2 is powered by an actuator, such as a gear motor.

Figure 5:
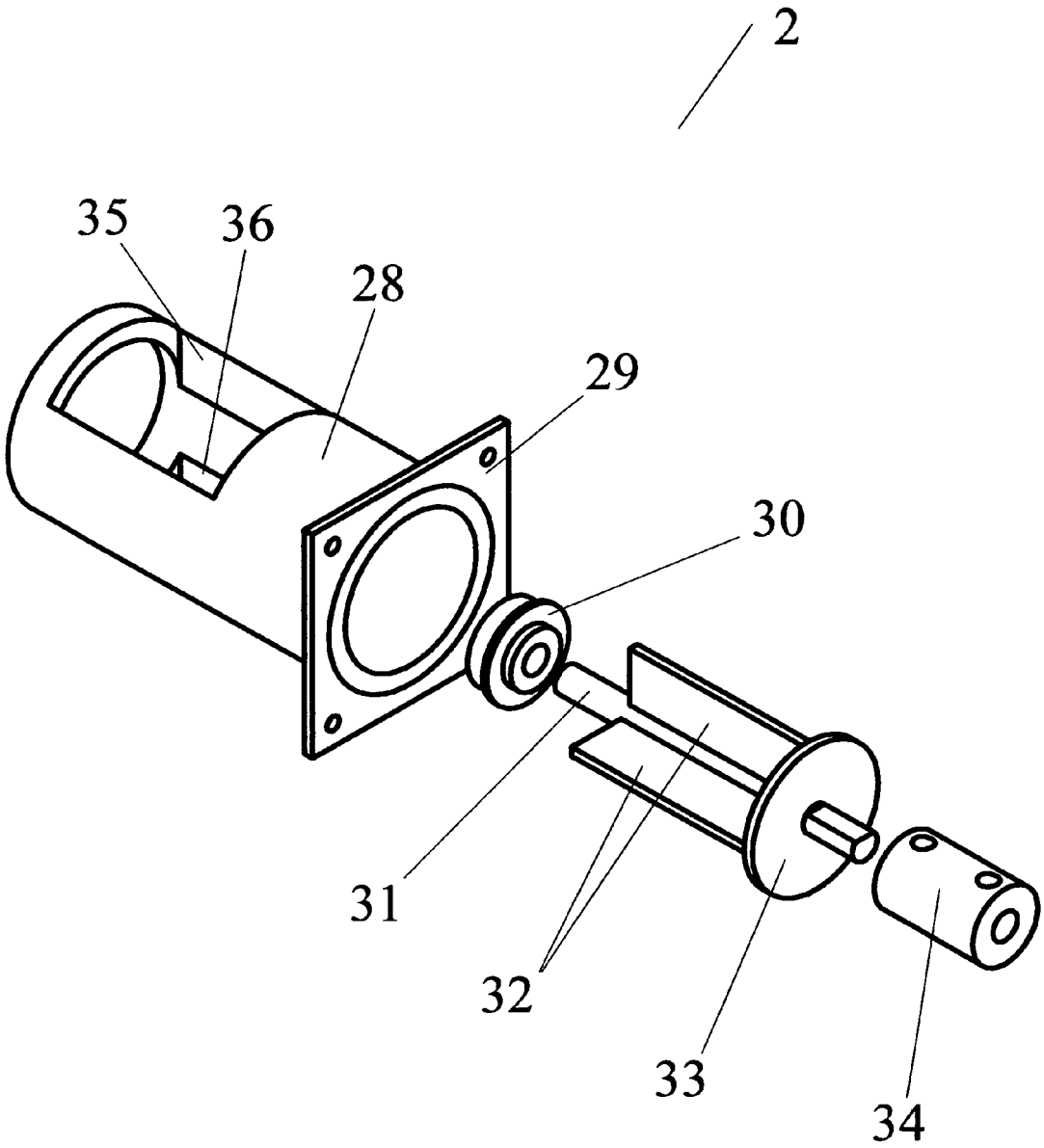
FIG. 5 shows an exploded view of one embodiment of a feeder, such as the feeder shown in FIG. 4.

FIG. 5 shows an exploded view of one embodiment of a feeder, such as the feeder 2 shown in FIG. 4. In this embodiment, the feeder 2 is a rotary valve. One skilled in the art will recognize that other embodiments may use different types of feeders 2, such as augers, lock hoppers, conveyers, or other feeding mechanisms. In the embodiment of FIG. 5, the feeder 2 includes a cylinder 28 that has an opening 35 on an upper portion that allows fuel to fall into the cylinder 28 from the hopper (1 in FIG. 4). Fuel flow through the feeder 2 is moderated by vanes 32, which rotate on a shaft 31. Fuel falls through opening 35 and onto the shaft 31 between the vanes 32. The shaft 31 and vanes 32 rotate, thereby allowing the fuel to fall through an outlet opening 36. The shaft 31 rotates on a bearing 30. A disk 33 directs fuel flow to the outlet opening 36. The actuator (3 in FIG. 4) mounts to the feeder 2 with a mounting plate 29. A coupling 34 connects the power source (3 in FIG. 4) to the shaft 31.

Figure 6:
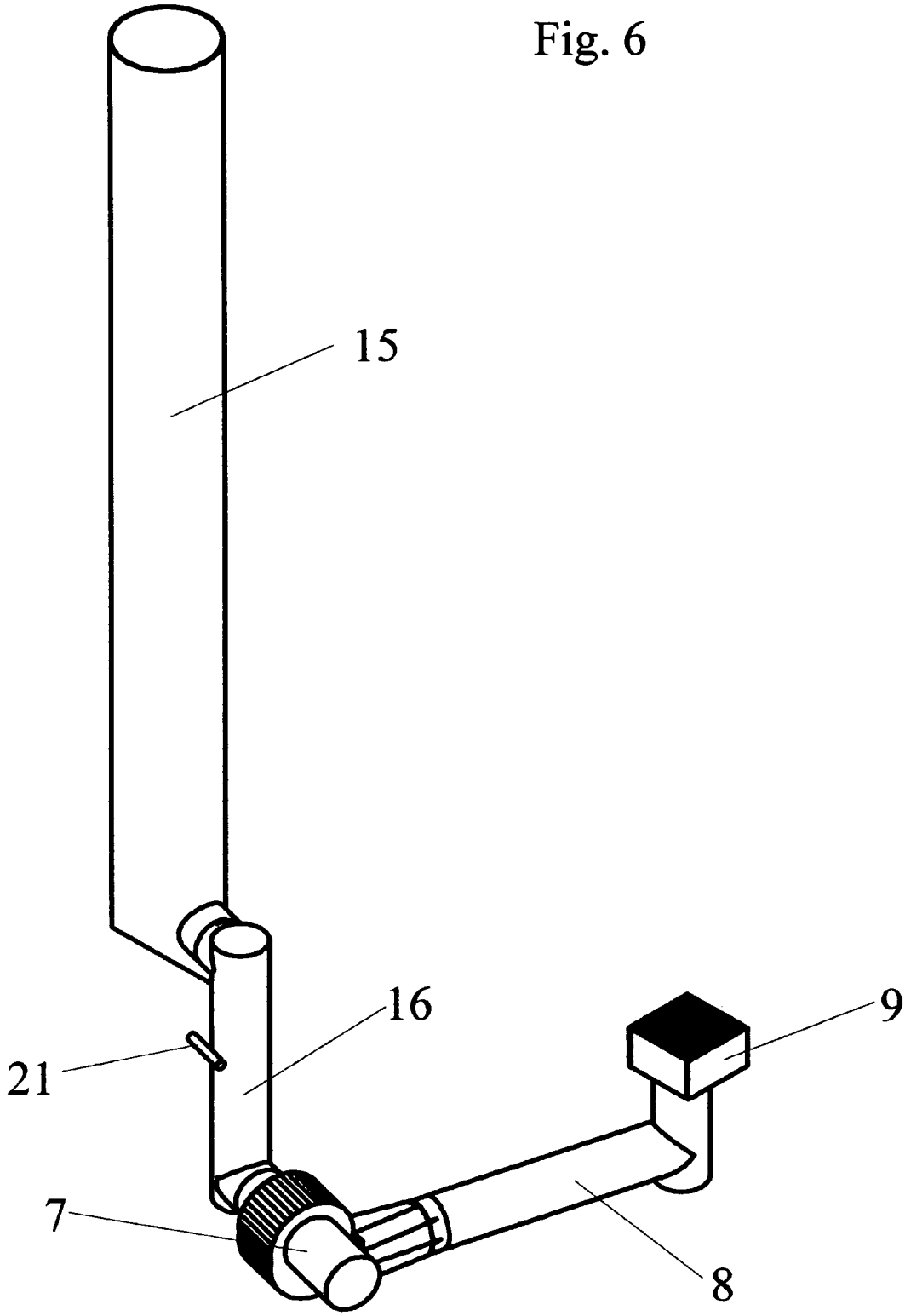
FIG. 6 shows a more detailed perspective view of the connection between the fan and the kiln wall.

FIG. 6 shows a more detailed perspective view of an arrangement for receiving the combustion air. The embodiment shown in FIG. 6 includes the outer pipe 15 of the pipe-in-pipe heat exchanger (17 in FIG. 1) that preheats combustion air. Air from the outer pipe 15 is directed to the fan 7 in the duct 16. The duct 16 includes the damper 21 that controls airflow to the fan 7. Air from the fan 7 passes through the duct 8 and into the air distribution grate 9. The air distribution grate 9 is located at the bottom of combustion chamber (10 in FIG. 1).

Figure 7:
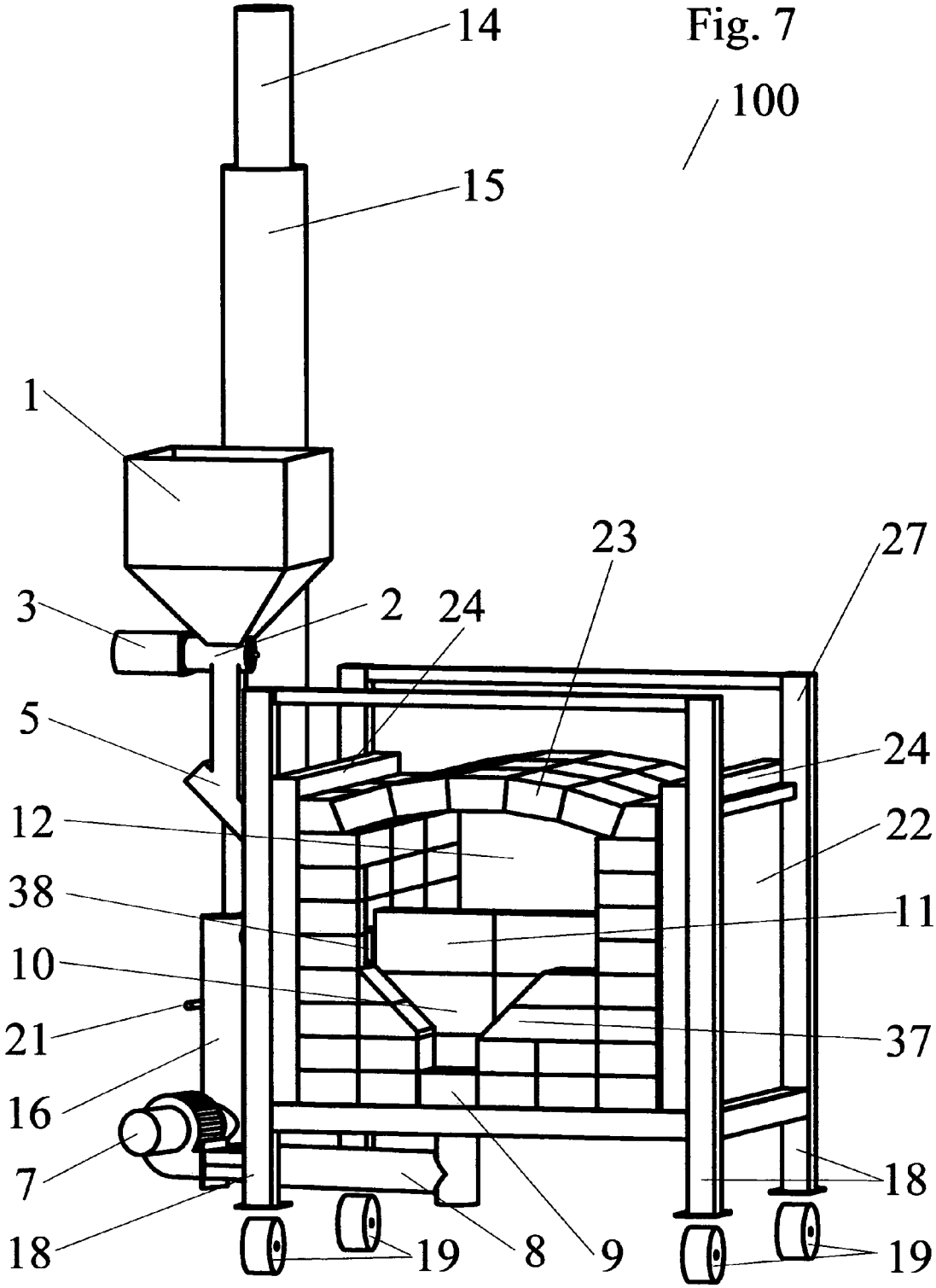
FIG. 7 shows a perspective view of the inside of the kiln.

FIG. 7 shows a perspective view of the inside of the kiln 100 from the combustion chamber side, without the door (26 in FIG. 3). In this embodiment, the duct 8 passes underneath the kiln 100 to provide air to the air distribution grate 9 in the combustion chamber 10. The combustion chamber 10 is separated from the main kiln volume 12 by a partition wall 11. Fuel drops into the combustion chamber 10 through a fuel chute 38, positioned through the kiln wall (6 in FIG. 1), which is composed of fire bricks 23, insulating board 24, and the metal shell 22. The fuel chute 38 directs fuel to the combustion chamber 10 using funnel-shaped chamber walls 37.

Figure 8:
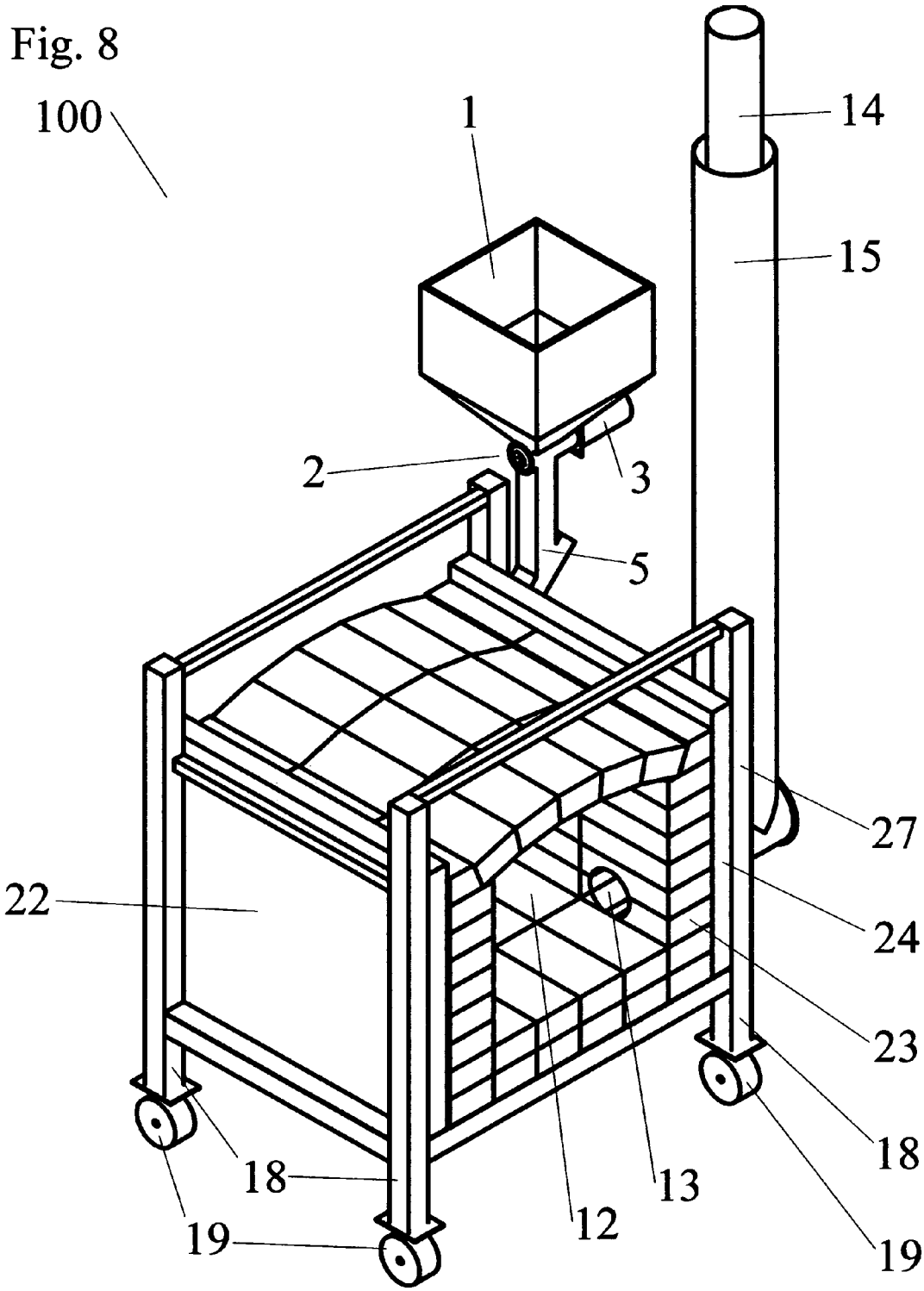
FIG. 8 shows a perspective view of the main kiln volume of the embodiment of the kiln shown in FIG. 7.

FIG. 8 shows a perspective view of the main kiln volume 12 of the embodiment of the kiln 100 shown in FIG. 7. An exhaust opening 13 provides exhaust gases to the exhaust stack 14.

By way of example, in one embodiment the kiln 100 is a small-sized kiln with an internal volume of 3.75 cubic feet. Conventional pellet-stove wood pellets are used as a solid fuel. Heat up to a full temperature of 2345° F. has been shown to be achieved using a total wood charge of 100 lbs in 9 hours. In this embodiment the volume of the hopper 1 is 0.7 cubic feet with a 30 lb capacity of wood pellets. Time between refilling the hopper 1 is approximately 2-3 hours. Fuel costs are $8.75 based on typical wood pellet costs of $3.50 per 40 lb bag. Because of the efficiency of this system, fuel costs compare favorably to a comparably sized conventional propane-fired kilns.

In this particular embodiment, fuel is fed using a 2-inch diameter auger as a feeder 2 and a 4-rpm gear motor as the actuator 3. The maximum fuel rate of the auger is 27 lbs per hour with the motor running continuously at 4 rpm. The fuel rate is controlled using a commercially available repeat cycle timing relay as a controller 4 to adjust the percentage of time the motor runs during a period of time. A 40% duty cycle is near optimum for this particular embodiment with a repeating cycle of 4 seconds with the motor running in a 10 second period. The fuel firing rate may be adjusted to balance available combustion air to yield a near neutral, maximum temperature flame. In one implementation, a neutral flame is used having a balanced fuel-to-air ratio such that combustion efficiency is maximum and combustion temperature is a maximum. In this particular embodiment, approximately 11 lbs per hour of wood fuel is supplied to balance 60 lbs per hour of combustion air.

Combustion air is supplied by a high-temperature blower as the fan 7, in this embodiment. The blower draws ambient air in through the annulus of the pipe-in-pipe heat exchanger 17. In this embodiment, the inner pipe 14 is approximately 4 inches in diameter and serves as the exhaust stack 14 for the kiln 100. The outer pipe 15 is 6 inches in diameter. The hot exhaust gasses leaving the kiln 100 provide heat to warm the incoming air. The length of the heat exchanger 17 is 4 feet in this particular embodiment and serves to heat the incoming air to a temperature of approximately 350° F.

Air preheat results in higher combustion temperatures which ease difficulties encountered in prior art in reaching full temperatures which are near to combustion temperatures with ambient temperature combustion air. Air preheat also recovers a portion of the exhaust gas heat which would otherwise be lost. Together, these impacts result in an efficiency improvement of approximately 46% based on fuel consumption of 100 lbs per firing compared to 187 lbs without air preheat in the same kiln 100.

Operations with air preheat are improved with target temperatures more reliably achieved with the hotter combustion temperatures compared to operations without air preheat where it can be difficult to achieve target temperatures even with extended firings.

Although the present invention has been described with respect to particular embodiments thereof, variations are possible. The present invention may be embodied in specific forms without departing from the essential spirit or attributes thereof. It is desired that the embodiments described herein be considered in all respects illustrative and not restrictive and that reference be made to the appended claims and their equivalents for determining the scope of the invention.

What is claimed is:

1. A kiln comprising:

a kiln wall defining a main kiln volume that is no larger than 60 cubic feet and is structured to receive a pottery item for firing;

a combustion chamber thermally connected to the main kiln volume;

a feeder that automatically feeds solid fuel to the combustion chamber to reach and maintain at least a cone 10 temperature within the main kiln volume;

a combustion air duct that provides combustion air to the fuel in the combustion chamber, and a heat exchanger that preheats the combustion air using exhausted combustion gas.

2. The kiln of claim 1, further comprising a fuel storage arrangement, and wherein the feeder automatically feeds the solid fuel from the storage arrangement to the combustion chamber.

3. The kiln of claim 1, further comprising a combustion air supply duct that provides combustion air to the solid fuel in the combustion chamber.

4. The kiln of claim 1, wherein the heat exchange comprises a first pipe that exhausts combustion gases from the combustion chamber and a second pipe that provides combustion air to the combustion air duct, wherein the first pipe is disposed within the second pipe.

5. The kiln of claim 1, wherein the fuel is granular and measures less than six inches in every direction.

6. The kiln of claim 1, wherein the kiln wall comprises a removable portion that provides access to the main kiln volume.

7. The kiln of claim 1, wherein the kiln wall comprises a door that provides access to the main kiln volume.

8. The kiln of claim 1, wherein the kiln wall comprises a fire brick, a metal shell, and an insulating material positioned between the fire brick and the metal shell.

9. The kiln of claim 1, further comprising a frame that supports the kiln wall, and a base assembly connected to the frame, wherein kiln is portable under a hand power, and wherein the base assembly allows movement of the kiln.

10. The kiln of claim 9, wherein the base assembly includes wheels that allow movement of the kiln.

11. The kiln of claim 1, further comprising a controller that controls a rate at which the feeder feeds the solid fuel.

12. A method of firing a kiln, comprising:

automatically providing solid fuel to a combustion chamber at a controlled rate;

combining the solid fuel with preheated combustion air in the combustion chamber; and combusting the solid fuel in the combustion chamber to warm a thermally-connected main kiln volume to at least a cone 10 temperature.

13. The method of claim 12, further comprising storing the solid fuel in a storage arrangement.

14. The method of claim 12, further comprising exhausting combustion gas from the combustion chamber.

15. The method of claim 12, wherein the combustion air is preheated using a heat exchanger.

16. The method of claim 12, further comprising exhausting gas from the combustion chamber using a first pipe, and wherein the combustion air is preheated using a pipe-in-pipe heat exchanger comprising the first pipe and a second pipe that provides combustion air to the combustion chamber.

17. The method of claim 12, wherein the step of providing comprises providing a solid fuel selected from the group consisting of: wood pellets, wood chips, sawdust, corn, grain, peat moss, and coal.

18. The method of claim 12, wherein the step of providing comprises providing a solid wood filet selected from the group consisting of; wood pellets, wood chips, and sawdust.

19. A kiln comprising:

means for automatically providing solid fuel to a combustion chamber at a controlled rate;

means for combining the solid fuel with combustion air in the combustion chamber;

means for preheating the combustion air; and means for combusting the solid fuel in the combustion chamber to reach at least a 10 cone temperature in a main kiln volume, wherein the main kiln volume is thermally connected to the combustion chamber and is no greater than 60 cubic feet.

20. The kiln of claim 19, further comprising means for storing the solid fuel, and wherein the means for automatically providing comprises means for providing fuel from the means for storing to the combustion chamber.

21. The kiln of claim 19, further comprising means for exhausting combustion gas from the combustion chamber, and wherein the means for preheating comprises means for preheating the combustion air using the exhausted combustion gas.

22. The kiln of claim 19, further comprising means for transporting the kiln across a surface.

23. A kiln comprising:

means for automatically providing solid fuel to a combustion chamber at a controlled rate;

means for combining the solid fuel with combustion air in the combustion chamber; and means for combusting the solid fuel in the combustion chamber to reach at least a 10 cone temperature in a main kiln volume, wherein the main kiln volume is thermally connected to the combustion chamber and is no greater than 60 cubic feet; and means for transporting the kiln across a surface.

24. The kiln of claim 23, further comprising:

means for exhausting combustion gas from the combustion chamber, and means for preheating the combustion air using the exhausted combustion gas.

25. A kiln comprising:

a kiln wall defining a main kiln volume that is no larger than 60 cubic feet and is structured to receive a pottery item for firing;

a combustion chamber thermally connected to the main kiln volume;

a feeder that automatically feeds solid fuel to the combustion chamber to reach and maintain at least a cone 10 temperature within the main kiln volume; and a heat exchanger comprising a first pipe that exhausts combustion gases from the combustion chamber and a second pipe that provides combustion air to the combustion air duct, wherein the first pipe is disposed within the second pipe.

26. The kiln of claim 25, further comprising a frame that supports the kiln wall, and a base assembly connected to the frame, wherein kiln is portable under a hand power, and wherein the base assembly allows movement of the kiln.

27. The kiln of claim 26, wherein the base assembly includes wheels that allow movement of the kiln.

28. The kiln of claim 25, wherein the base assembly includes wheels that allow movement of the kiln.

29. A kiln comprising:

a kiln wall defining a main kiln volume that is no larger than 60 cubic feet and is structured to receive a pottery item for firing;

a combustion chamber thermally connected to the main kiln volume;

a feeder that automatically feeds solid fuel to the combustion chamber to reach and maintain at least a cone 10 temperature within the main kiln volume;

a frame that supports the kiln wall; and a base assembly connected to the frame, wherein kiln is portable under a hand power, and wherein the base assembly allows movement of the kiln.

* * * * *